US008456305B2

(12) United States Patent
Gates

(10) Patent No.: US 8,456,305 B2
(45) **Date of Patent: *Jun. 4, 2013**

(54) REDUNDANT SECURITY SYSTEM

(76) Inventor: Tell A. Gates, Falls Church, VA (US)

( * ) Notice: Subject to any disclaimer, the term of this patent is extended or adjusted under 35 U.S.C. 154(b) by 771 days.

This patent is subject to a terminal disclaimer.

(21) Appl. No.: 11/701,369

(22) Filed: Feb. 2, 2007

(65) Prior Publication Data

US 2008/0186173 A1 Aug. 7, 2008

Related U.S. Application Data

(63) Continuation-in-part of application No. 11/284,002, filed on Nov. 22, 2005, now Pat. No. 8,193,935.

(51) Int. Cl.
*G08B 13/00* (2006.01)
*G08B 13/14* (2006.01)

(52) U.S. Cl.
USPC ..... 340/542; 340/541; 340/572.1

(58) Field of Classification Search
USPC ..... 340/541–545.9, 572.1, 686.1, 539.1, 340/10.1, 5.73; 109/1 R, 1 V
See application file for complete search history.

(56) References Cited

U.S. PATENT DOCUMENTS 4,831,374 A * 5/1989 Masel ..... 340/5.33
5,300,875 A * 4/1994 Tuttle ..... 320/138
5,602,526 A * 2/1997 Read ..... 340/457
5,615,625 A * 4/1997 Cassidy et al. ..... 109/45
5,973,598 A * 10/1999 Beigel ..... 340/572.1
6,040,771 A * 3/2000 Kim ..... 340/545.1
6,297,737 B1 * 10/2001 Irvin ..... 340/571
6,747,558 B1 * 6/2004 Thorne et al. ..... 340/551
6,888,459 B2 * 5/2005 Stilp ..... 340/541
6,921,990 B1 * 7/2005 Higgins ..... 307/328
7,057,510 B2 * 6/2006 Maniaci ..... 340/545.6
7,348,875 B2 * 3/2008 Hughes et al. ..... 340/10.4
7,403,120 B2 * 7/2008 Duron et al. ..... 340/572.1
7,495,544 B2 * 2/2009 Stilp ..... 340/10.1
7,579,951 B2 * 8/2009 Hirahara et al. ..... 340/572.1
7,755,486 B2 * 7/2010 Zhu et al. ..... 340/572.1
2003/0160681 A1 * 8/2003 Menard et al. ..... 340/5.64
2003/0184438 A1 * 10/2003 Williams et al. ..... 340/545.2
2005/0184857 A1 * 8/2005 Roatis et al. ..... 340/5.73
2007/0139197 A1 * 6/2007 Hopman ..... 340/572.1
2007/0210923 A1 * 9/2007 Butler et al. ..... 340/572.8

* cited by examiner

*Primary Examiner* — Hai Phan
*Assistant Examiner* — Kaleria Knox
(74) *Attorney, Agent, or Firm* — Dan Fiul

(57) ABSTRACT

A redundant security system relies on a Radio Frequency Identification (RFID) tag to convey security sensor data. If the RFID tag is unable to convey security sensor data, a backup photoelectric cell powered transmitter is activated to transmit security sensor data to a monitoring station. Alternately, a security safe is outfitted with a RFID tag based security sensor. The RFID tag allows remote monitoring of at least one of an opened/closed condition and a locked/unlocked condition of a door of the security safe.

13 Claims, 14 Drawing Sheets

DOOR-WINDOW MONITOR BLOCK DIAGRAM

REDUNDANT SECURITY SYSTEM

This application is a continuation-in-part of U.S. application Ser. No. 11/284,002, entitled "RFID PERIMETER ALARM MONITORING SYSTEM" filed on Nov. 22, 2005, now U.S. Pat. No. 8,193,935, the entirety of which is expressly incorporated herein by reference.

BACKGROUND OF THE INVENTION

1. Field of the Invention

This invention relates generally to security systems. More particularly, it relates to a redundant security system.

2. Background

Security systems are becoming increasingly commonplace, especially within homes. In particular, security systems based on wired sensors and wireless sensors relying on batteries are used to detect intrusions within homes and businesses.

FIG. 6 shows a conventional wired security system 601 based on wired sensors throughout a home or business attached to a main control panel controlled by a remote user panel.

In particular, FIG. 6 shows a conventional wired security system 601 comprising a wired door sensor 610, a door 615, a wired window sensor 620, a window 625, a wired motion sensor 630, a wired main control panel 640, a wired remote user panel 650 and a speaker 670.

A conventional wired security system 601 is configured in a hub and spoke topology. The remote user panel 650 acts as a hub to all of the spokes within the system comprising the wired door sensor 610, the wired window sensor 620, the wired motion sensor 630 and the wired remote user panel 650.

The wired remote user panel 650 is used to activate and deactivate the conventional wired security system 601. Moreover, the wired remote user panel 650 provides visual indication of the status of the conventional wireless security system 601, such as activation status, individual zone status, etc.

The wired main control panel 640 constantly monitors the output of: the wired door sensor 610, attached to door 615, the wired window sensor 620, attached to window 625, and the wired motion sensor 630. If any of the wired door sensor 610, the wired window sensor 620, and the wired motion sensor 630 detect an intrusion within an associated zone, the wired main control panel 640 activates the speaker 670 to audibly alert occupants of a building being monitored by the wired main control panel 640 of a possible intrusion.

The drawback of a conventional wired security system 601 is the need to pre-wire the system, i.e., during construction of a building or post-wire the system, i.e., after construction of a building. Post-wiring a conventional wired security system 601 potentially runs into such issues as access to open walls to run wires, less than optimal placement of sensors due to limitations created by installation issues, time, cost, the need to hire a professional installer, etc.

FIG. 7 shows a conventional wireless security system 701 based on wireless sensors throughout a premises wirelessly connected to a main control panel controlled by a remote user panel.

In particular, FIG. 7 shows a conventional wireless security system 701 comprising a wireless door sensor 710, a door 715, a wireless window sensor 720, a window 725, a wireless motion sensor 730, a main control panel 740, a wireless remote user panel 750, a central monitoring station 755 and a speaker 770.

The wireless remote user panel 750, typically located near a doorway, is used to activate and deactivate the conventional wireless security system 701. Moreover, the wireless remote user panel 750 provides visual indication of the status of the conventional wireless security system 701, such as activation status, individual zone status, etc.

The main control panel 740 constantly monitors the output of: the wireless door sensor 710, attached to door 715, the wireless window sensor 720, attached to window 725, and the wireless motion sensor 730. If any of the wireless door sensor 710, the wireless window sensor 720 and the wireless motion sensor 730 detect an intrusion within an associated zone, the main control panel 740 activates the speaker 770 to audibly alert occupants of a building being monitored by the wireless remote user panel 740 of a possible intrusion, relays the alert to the wireless remote user panel 750 for display of the alert information, and alerts the optional central monitoring station 755.

The drawback of a conventional wireless security system 701 is the need to replace batteries within the system, i.e., a battery within the wireless door sensor 710, a battery within the wireless window sensor 720, a battery within the wireless motion sensor 730, and a possibly a battery within the wireless remote user panel 750. A dead battery within a large premises having a large number of wireless window sensors 720 and wireless motion sensors 730 can leave a significant portion of a building unprotected in the event of an intrusion. Even worse, a dead battery within the wireless remote user panel 750 completely disables the local reporting in the conventional wireless security system 701. Moreover, a dead battery within a large premises having a large number of windows can result in significant time and effort expended to periodically change out batteries, typically every two to three years to ensure all batteries within the system are powered.

As a result of the drawbacks cited above for both conventional wired 601 and wireless security systems 701, there is a need for apparatus and methods which allow security systems to be more easily installed than with a wired home security system and without a wireless security system's reliance on sensors powered by replacement batteries. Moreover, there exits a need for apparatus and methods which allow security systems to have a backup system to convey security data in the event the primary system becomes disabled.

SUMMARY OF THE INVENTION

The present invention provides for a redundant security sensor that is comprised of a photoelectric cell, a passive sensor to detect a security condition and a security switch. A wireless transmitter wirelessly transmits sensor data associated with the security switch with power generated from the photoelectric cell.

A redundant security apparatus and method are disclosed that perform a determination if a Radio Frequency Identification (RFID) radio frequency (RF) field is detected. Upon a determination that the RFID RF field is undetected, a photoelectric cell powered security transmitter is activated.

In accordance with another embodiment of the present invention, a security safe is comprised of a passive sensor to detect at least one of an open/close condition and a locked/unlocked condition of a security safe door.

A method of monitoring a security safe is disclosed comprising detection of at least one of an opened/closed condition and a locked/unlocked condition of a door of the security safe. The detected at least one of the opened/closed condition and the locked/unlocked condition of the door of the security safe is conveyed with a passive element.

BRIEF DESCRIPTION OF THE DRAWINGS

Features and advantages of the present invention will become apparent to those skilled in the art from the following description with reference to the drawings, in which.

DETAILED DESCRIPTION OF ILLUSTRATIVE EMBODIMENTS

The present invention provides a Redundant Security System (RSS) that relies on wireless security sensors that do not require a replaceable battery, i.e., a battery that periodically requires replacement, or other power source to monitor for an intrusion within a home (e.g., door sensors and/or window sensors). In accordance with the principles of the present invention, electrical outlet/phone outlet/security system sensor monitors check the status of Radio Frequency Identification (RFID) sensors and relay any possible intrusions to a remote user panel for activation of a user alert. In the event the RFID based monitoring becomes disabled for whatever reason, a photoelectric based monitoring is activated to convey security data. In this manner, the probability of conveying security data to a main control panel is optimized.

The RSS provides a system and method to monitor windows and doors without retrofitting a building's wiring. The RSS eliminates a requirement of annual replacement of batteries at each door and/or window sensor within the system, while concurrently providing for redundancy for applications where security is crucial.

With the RSS, no replaceable battery, compartment, and cover are required. As a result of a lack of a replaceable battery, compartment and cover, the size of the door sensors and/or window sensors can be made extremely small. This allows the door sensors and window sensors to be embedded in the window latch or the door lock, thereby improving the ease and aesthetics of the installation.

Figure 1:
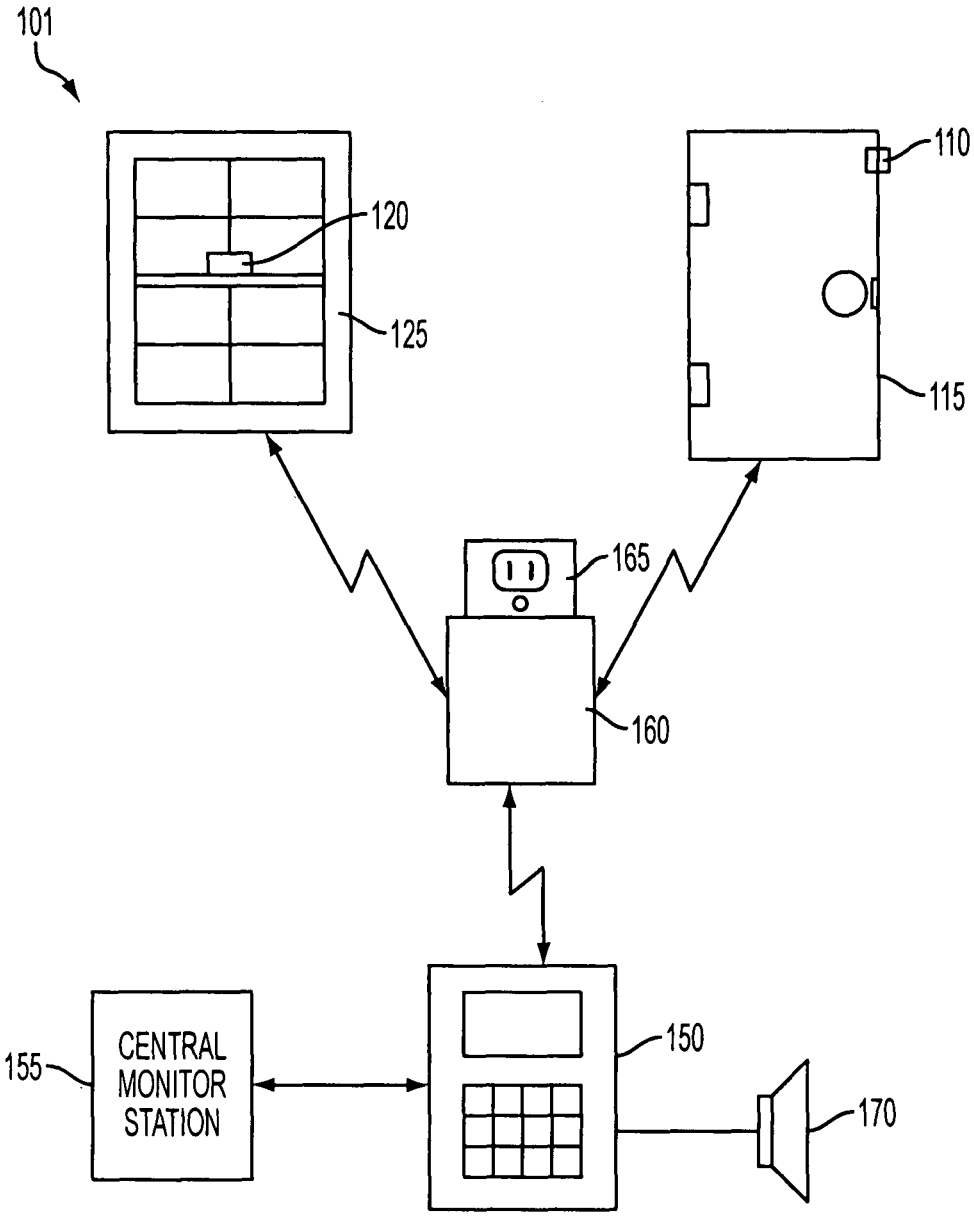
FIG. 1 shows an overview of a wireless home security system relying on RFID sensors, in accordance with the principles of the present invention.

FIG. 1 shows a system level view of a RFID Perimeter Alarm Monitoring System (RPAM) 101, in accordance with the principles of the present invention.

In particular, as shown in FIG. 1, the RPAM 101 is comprised of a wireless window sensor 120, a window 125, a wireless door sensor 110, a door 115, a wireless local interface 160, a conventional wall outlet 165, a remote user panel 150, a central monitoring station 155 and a speaker 170.

A single wireless window sensor 120, a single wireless door sensor 110, a single wireless local interface 160, and a single user panel 150 are show in FIG. 1 for simplification of illustration only. Within an actual implementation of the RPAM 101 in accordance with the principles of the present invention, the number of wireless window sensors 120, wireless door sensors 115, wireless local interfaces 160 and user panels 150 is unlimited, i.e., based on the size and configuration of the premises being monitored.

The wireless window sensor 120 is illustrated as being incorporated in a lock mechanism of window 125. To simplify incorporation of a wireless window sensor 120 into a window 125 at the time of manufacture and to retrofit a premise with a wireless door sensor 120 in accordance with the invention, the wireless window sensor 120 can be manufactured to fit within a conventional window lock housing. A spring loaded magnetic switch, a mechanical switch, or similar switch, activates a change in bit value in an RFID tag embedded in the wireless window sensor 120 to signal a possible intrusion within a premises being monitored by the RPAM 101.

The wireless door sensor 110 is illustrated as being incorporated in a door 115. To sense an opening of door 115, a second portion of the wireless door sensor 110 is incorporated into a door frame, not shown. To simplify incorporation of a wireless door sensor 110 into a door 115 at the time of manufacture and to retrofit a premises with a wireless door sensor 110 in accordance with the invention, the wireless door sensor 110 can be manufactured to fit within a conventional door lock housing. A spring loaded magnetic switch, a mechanical switch, or similar switch activates a change in bit value in an RFID tag embedded in the wireless door sensor 110 to signal a possible intrusion within a premises being monitored by the RPAM 101.

Moreover, the wireless window sensor 120 and wireless door sensor 110 can be used to detect whether their respective associated window 125 and door 115 latch/lock mechanisms are latched/locked. A mechanical switch activates a change in bit value in an RFID tag embedded in the wireless window sensor 120 and wireless door sensor 110 to signal a change in latch/lock value. In this manner, the RPAM can be used to determine if windows and/or doors within a building being monitored are latched/locked in addition to monitoring if window 125 and/or door 115 has been opened.

The wireless local interface 160 conveniently plugs into a conventional wall outlet 165 for power. A polling signal is emitted from the wireless local interface 160 to read a value of an RFID embedded in the wireless window sensor 120 and the wireless door sensor 110. The RFID value read from the wireless window sensor 120 and the wireless door sensor 110 is transmitted to the remote user panel 150.

The remote user panel 150 receives the RFID value transmitted from the wireless local interface 160. The RFID value is compared to a previously stored RFID value. If the RFID value is different than a previously stored RFID value, the speaker 170 is activated to alert a user of a potential intruder within a premises being monitored by the RPAM 101. Optionally, the central monitoring center 155 is called through a telephone interface to alert local police of a possible intrusion. Such central monitoring service is an optional paid service that is not required to operate the RPAM 101 as a deterrent to an intruder entering a premises with speaker 170 sounding an alarm.

The remote user panel 150 is used to activate and deactivate the RPAM 101. Moreover, the user panel 150 provides visual indication of the status of the RPAM 101, such as activation status, individual zone status, etc.

During initial setup of the RPAM 101, all of the RFID sensors within the RPAM 101 are polled for storage of baseline values of the RFID sensors within the RPAM 101. The baseline RFID values are constantly compared to RFID values polled from wireless window sensor 120 and the wireless door sensor 110 for a determination of a change in value indicating opening of a latch/lock mechanism and a possible intrusion.

As discussed above, a single wireless window sensor 120, a single wireless door sensor 110, a single wireless local interface 160, and a single user panel 150 are show in FIG. 1 for simplification of illustration only. During an implementation of the RPAM 101, multiple addresses in the wireless local interfaces 160 emulate, as well as differentiate zone types, such as a door open delay area vs. an instant alarm window opening detected.

Figure 2:
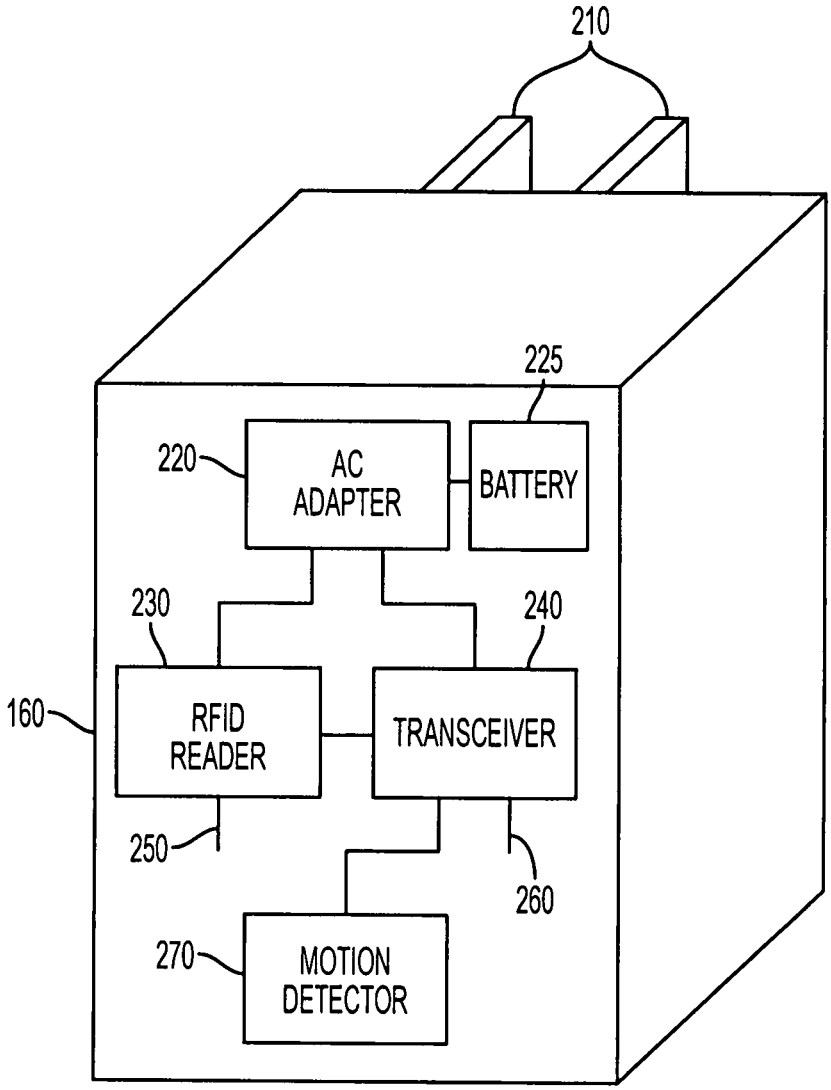
FIG. 2 shows a detailed view of the wireless local interface from FIG. 1, in accordance with the principles of the present invention.

FIG. 2 shows a detailed view of the wireless local interface 160 as shown in FIG. 1, in accordance with the principles of the present invention.

In particular, the wireless local interface 160 is comprised of electrical outlet connectors 210, an AC adapter 220, a battery 225, an RFID reader 230, a transceiver 240, an RFID antenna 250 and a transceiver antenna 260.

The electrical outlet connectors 210 allow the wireless local interface 160 to receive power from the standard wall outlet 165 shown in FIG. 1.

Battery 225 allows the wireless interface extender 160 to perform its functions in the event that wireless interface extender 160 is unable to obtain power from a conventional wall outlet 165. Although not show in FIG. 1 for convenience, an AC power sensor is used to determine if the wireless interface extender 160 is obtaining power from the conventional wall outlet 165. If the AC power sensor determines that the wireless interface extender 160 is not obtaining power from the conventional wall outlet 165, a switch is triggered to allow the wireless interface extender 160 to be powered by battery 225.

A polling signal is emitted from the wireless local interface 160 by the RFID reader to read a value of an RFID embedded in the wireless window sensor 120 and the wireless door sensor 110 through antenna 250. The RFID value read from the wireless window sensor 120 and the wireless door sensor 110 changes if the window 125 and/or door 115 has been opened by an intruder.

Transceiver 240 is connected to RFID reader 230. The RFID values polled from the wireless window sensor 120 and the wireless door sensor 110 are received from the RFID reader 230 for transmission to the remote user panel 150 through transceiver antenna 260.

Optionally, wireless local interface 160 comprises motion detector 270. The motion detector 270 provides backup intrusion detection in the event that an intruder is able to gain access to a premises without opening window 125 and door 115, and in the event that the wireless window sensor 120 and the wireless door sensor 110 become inoperable.

The communications path between the wireless local interface 160 and the remote user panel 150 can utilize any wired or wireless technology, such as X10 power line communications, Bluetooth, etc. The system is optionally compatible with conventional wireless security systems at the interface of the transceiver 240 in the wireless local interface 160.

Figure 3:
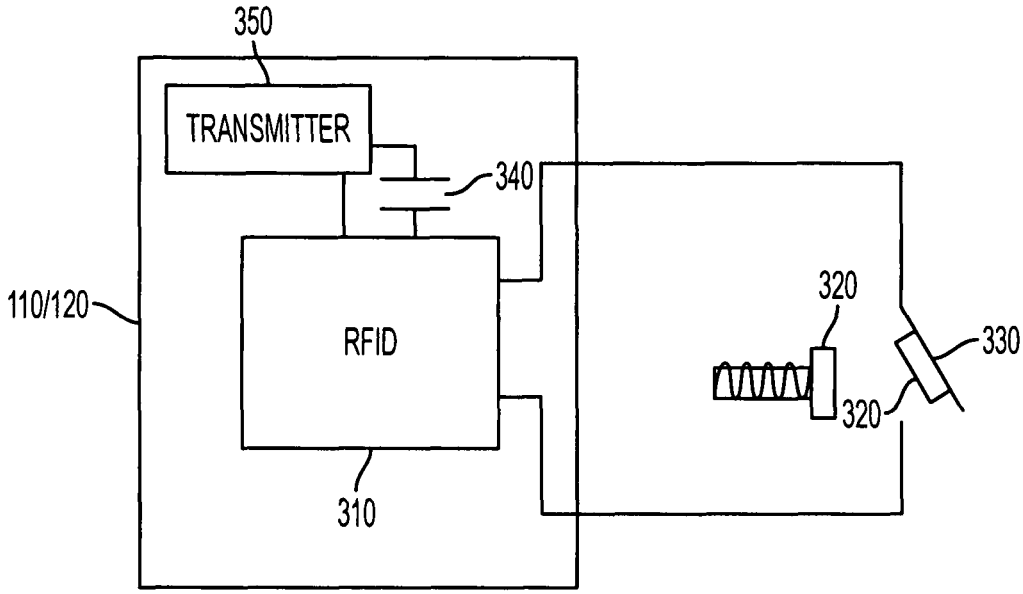
FIG. 3 shows a detailed view of the sensors used in the wireless window sensor and the wireless door sensor from FIG. 1, in accordance with the principles of the present invention.

Although the exemplary wireless local interface 160 shown in FIG. 3 is shown as being plugged into the conventional wall outlet 165 for power, for a more aesthetic installation the wireless local interface is incorporate into a wall switch, a wall power outlet, a telephone line outlet and/or a powered home security device such as a smoke detector, motion detector, glass break detector, etc. From all appearances, the wireless local interface would therefore be indistinguishable from a conventional wall power outlet and/or a telephone line outlet. This arrangement has the advantage of disguising the zones being covered by the RPAM 101 from an intruder and at the same time freeing an outlet for conventional use of two plug-in devices for power and/or a plug-in for a telephone.

Moreover, RFID antenna 250, transceiver antenna 260 and an antenna within the remote user panel 150 can be directional antennas for optimizing communications within the RPAM 101. A directional antenna's orientation can be adjusted to maximize a communication signal's strength and associated distances between components within the RPAM 101. In this manner, obstruction from such obstacles as other electronics, power lines, pipes, etc. can be minimized.

FIG. 3 shows a detailed view of the battery-less sensors, i.e., sensors lacking any type of power supply, used in the wireless window sensor 120 and the wireless door sensor 110 from FIG. 1, in accordance with the principles of the present invention.

In particular, the wireless window sensor 120 and the wireless door sensor 110 comprise an RFID tag 310, a wireless sensor switch 330, a magnetic spring actuator 320, a wireless sensor capacitor 340, a wireless sensor transmitter 350.

During operation, the RFID tag 310 is continuously monitored for a determination of a change in value that equates to a possible intrusion. The magnetic spring actuator 320 opens and closes the wireless sensor switch 330 according to an opening and closing of the window 125 and door 115. The open and close position of the wireless sensor switch 330 changes a bit value produced by the RFID tag 310. The bit value produced by the RFID tag 310 is compared to a previously stored RFID value during initialization of the RPAM 101. In this manner, the RFID tag 310 allows a determination of the opening and closing of the window 125 and door 115 without use of a battery within a wireless sensor.

Preferably, but not required for operation of the RPAM, the wireless window sensor 120 and the wireless door sensor 110 include a wireless sensor capacitor 340 for energy storage to activate the optional wireless sensor transmitter 350 to signal an alert during a period of time when the wireless window sensor 120 and the wireless door sensor 110 are not polled by the wireless local interface 160. The capacitor 340 is energized preferably during the polling of the wireless window sensor 120 and the wireless door sensor 110, although the capacitor 340 can be energized with a separate signal from the wireless local interface 160 or any other local devices.

Figure 4:
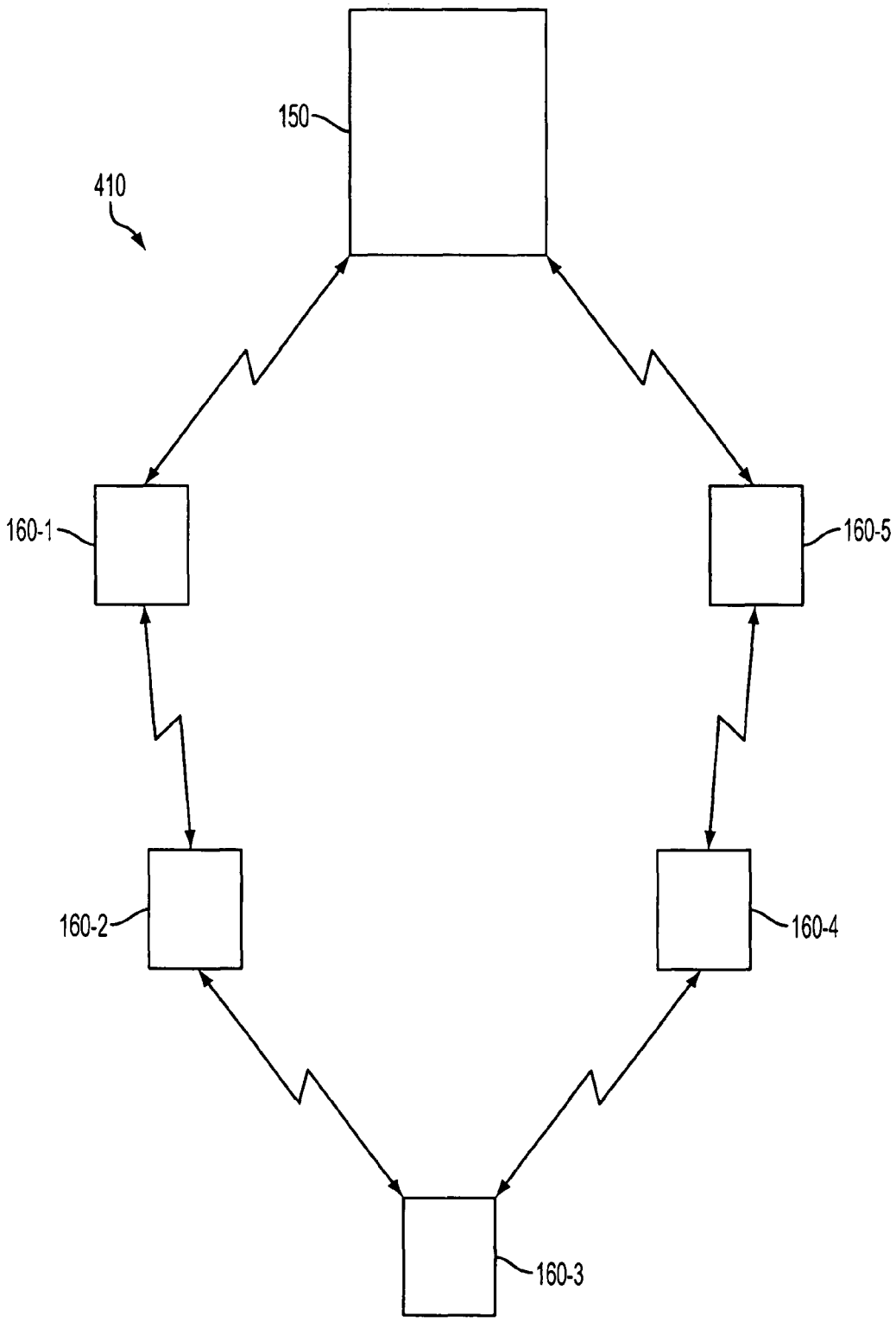
FIG. 4 shows an alternate embodiment utilizing a security network formed from a plurality of wireless local interfaces communicating with a remote user panel, in accordance with the principles of the present invention.

FIG. 4 shows a security network formed from a plurality of wireless local interfaces for communication with a remote user panel.

In particular, the security network 410 is comprised of the remote user panel 150, a first wireless local interface 160-1, a second wireless local interface 160-2, a third wireless local interface 160-3, a fourth wireless local interface 160-4 and a fifth wireless local interface 160-5.

In many large premises the distance between the remote user panel 150 and the farthest window 125 or door 115 being monitored is greater than an allowable transmission strength under Federal Communications Commission (FCC) regulations for communications there between. Thus, for wireless transmissions, a signal strength of a wireless local interface must be below that required for registration with the FCC. However, communications using low signal strengths between a farthest wireless local interface 160 and remote user panel 150 can be facilitated through a security network 410, as discussed below.

To allow a remote user panel 150 to communicate with a farthest wireless local interface 160 within a large premises, a security network 410 is formed between the first wireless local interface 160-1, the second wireless local interface 160-2, the third wireless local interface 160-3, the fourth wireless local interface 160-4 and the fifth wireless local interface 160-5. In this manner, the remote user panel 150 is able to indirectly communicate with farthest wireless local interface 160-3 indirectly through any one of the first wireless local interface 160-1, the second wireless local interface 160-2, the fourth wireless local interface 160-4 and the fifth wireless local interface 160-5. An indication of an intruder can be passed between any of the components within the security network 410, communications only being limited by the ability to establish communications between the various components.

Existing wireless networking protocols to establish a security network 140 between the first wireless local interface 160-1, the second wireless local interface 160-2, the third wireless local interface 160-3, the fourth wireless local interface 160-4 and the fifth wireless local interface 160-5 include Bluetooth™, HomeRF, WiFi, etc. However, since the wireless local interfaces 160 are connected to a wall power outlet and/or a telephone line outlet, wired networking protocols can be used to establish a security network 410. Wired network protocols include X10 power line communications, HomePlug™, HomePNA, etc. Therefore, the area covered by the RPAM 101 is only limited by the number of wireless local interfaces 160 used to create the security network 410 and not by the size of the premises being monitored by the RPAM 101.

In the example of a BLUETOOTH piconet, the current standards permit one (1) master and seven (7) slaves to be active in the piconet at any one time. In accordance with the principles of the present invention, after a wireless local interface 160 enters the piconet wireless network as a slave and communicates with an appropriate master wireless local interface 160 and/or a remote user panel 150, that wireless local interfaces 160 may then be placed into a 'park' mode. In this way, many more than seven (7) wireless local interfaces 160 may be utilized at any one time. Of course, multiple masters will also permit an increase in the number of wireless local interfaces 160 which may be used in a particular system, with the multiple masters being connected to form a scatternet.

Although five wireless local interfaces and a single remote user panel are shown in FIG. 4, any number of wireless local interfaces and remote user panels can be used with the invention. The actual number of wireless local interfaces and remote user panels is only dependent on the number desired/required by a user for a particular application.

Figure 5:
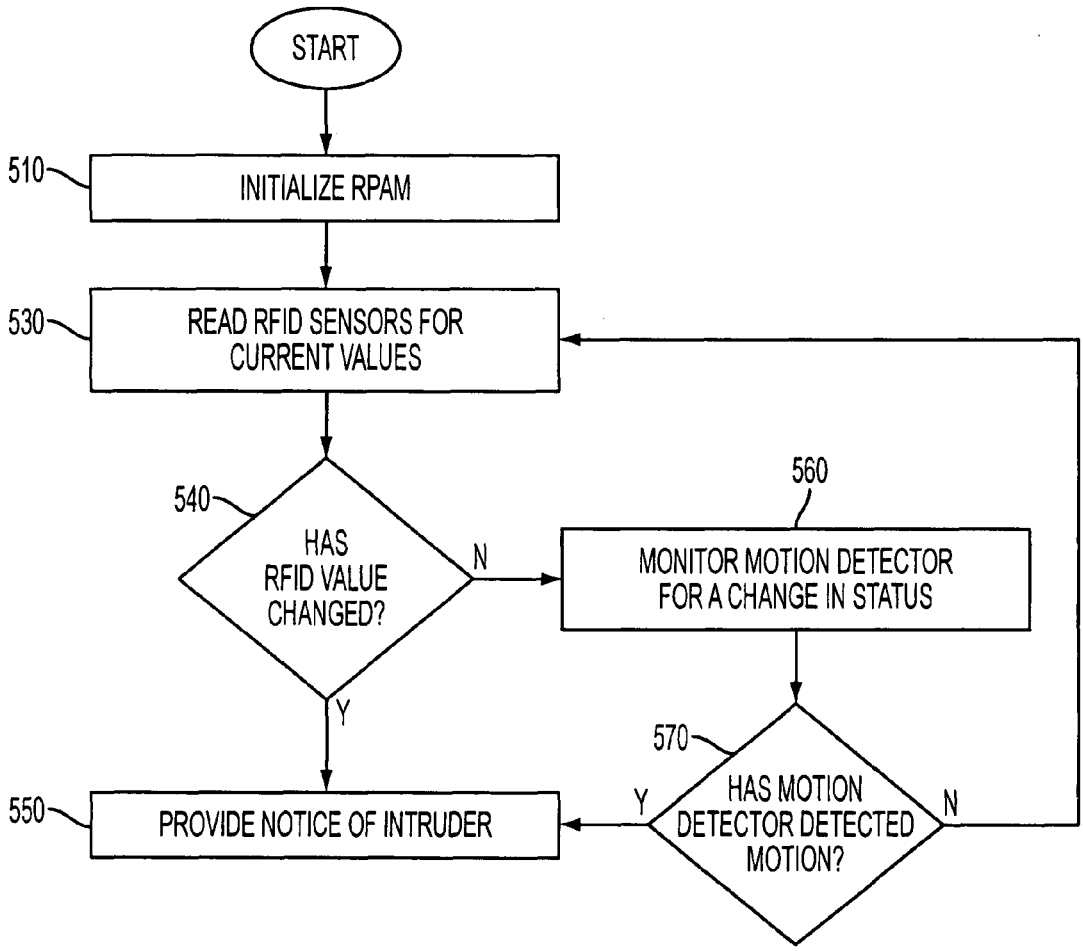
FIG. 5 shows a process by which a wireless security system in accordance with principles of the present invention monitors for an intruder.
Figure 6:
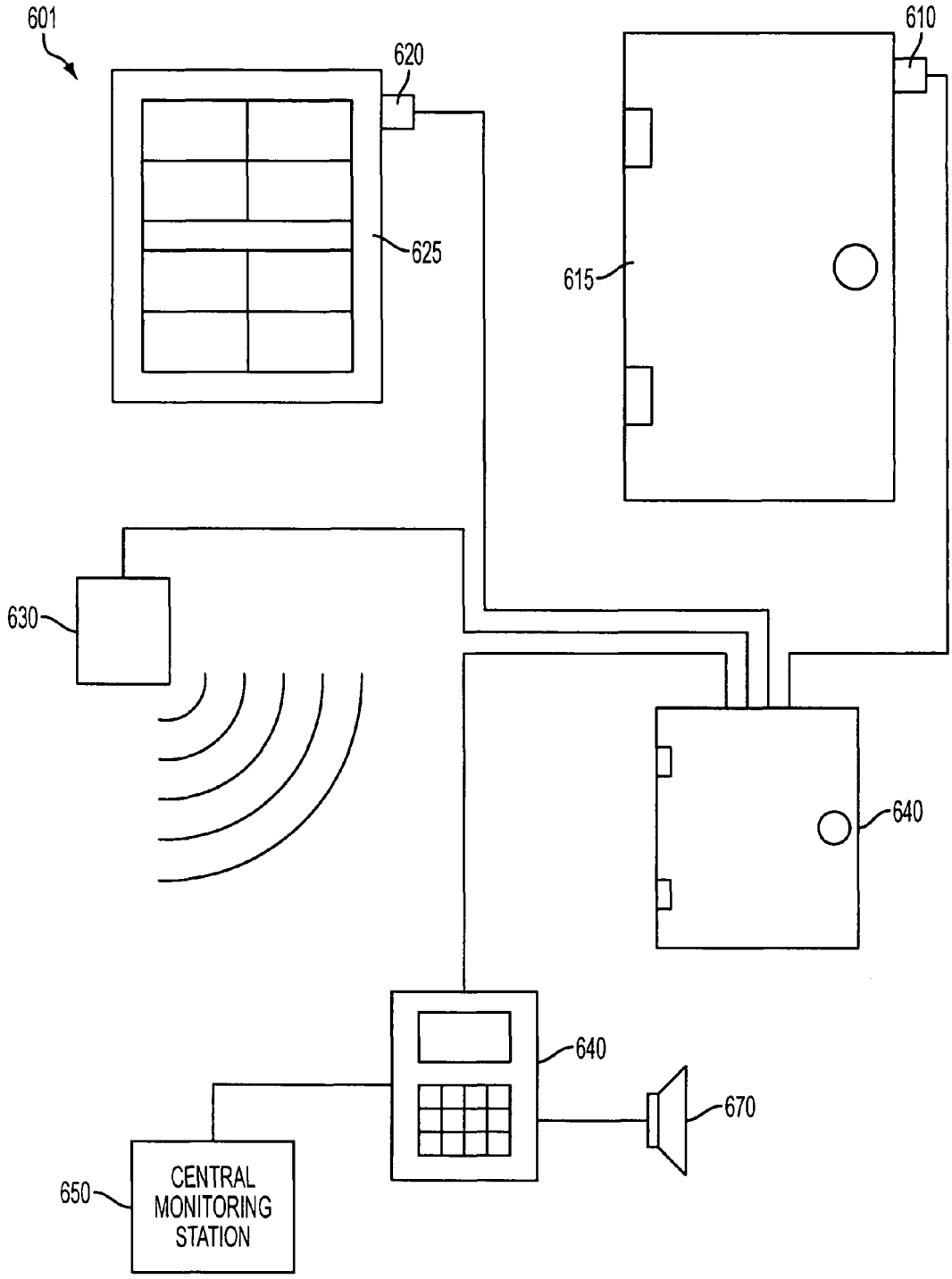
FIG. 6 PRIOR ART
FIG. 6 shows a conventional wired security system.
Figure 7:
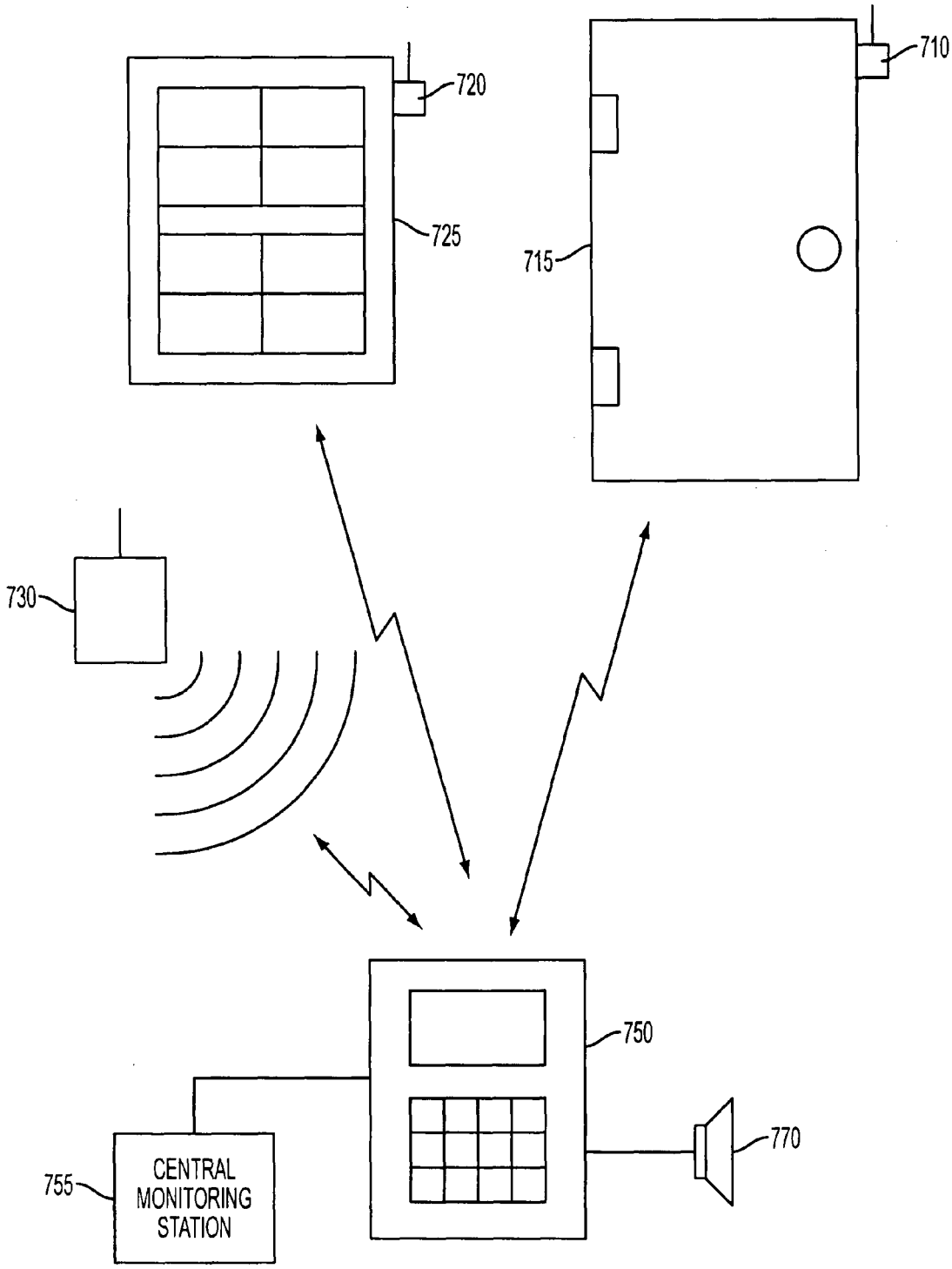
FIG. 7 PRIOR ART
FIG. 7 shows a conventional wireless security system.

FIG. 5 shows a process by which a wireless security system in accordance with principles of the present invention monitors for an intruder, as shown in FIGS. 1 and 4.

In step 510, the RPAM 101 is initialized, as discussed above. With all of the doors and windows within a premises closed, a menu option is selected on the remote user panel 150 to initialize the RPAM 101 to establish baseline values for all of the wireless door sensors 110 and wireless window sensors 120 within the system, i.e., values from the various wireless door sensors 110 and wireless window sensors 120 are read by the wireless local interface 160 in the closed position.

In step 530, when the RPAM 101 is activated for monitoring a premises, the current values of the various wireless door sensors 110 and wireless window sensors 120 are read by the wireless local interface 160, and relayed to the remote user panel 150.

In step 540, the baseline values for the wireless door sensor 110 and wireless window sensor 120 within the system are compared to current values of the wireless door sensor 110 and wireless window sensor 120 read in step 530 for a determination of an intruder. Step 540 conditionally branches based on an outcome of the comparison, i.e., branches to step 560 if the baseline values are the same as the current wireless sensor values and branches to step 550 if the baseline values are different than the current wireless sensor values.

In step 550, a notice is provided of an intruder through speaker 170 based on the determination that the baseline values are different than the current wireless sensor values in step 540.

In step 560, optional motion detector 270 is monitored for a determination of motion within a field of view of wireless local interface 160.

In step 570, a determination is made if motion detector 270 has detected motion. If the motion detector 270 detects motion within a field of view of wireless local interface 160, step 570 conditionally branches based on detected motion, i.e., branches to step 530 if no motion is detected and branches to step 550 if motion is detected. If motion is detected, step 550 provides notice of an intruder through speaker 170. If motion is not detected, step 530 starts the process anew to determine if an intruder has entered a premises being monitored by RPAM 101.

An alternative embodiment of the present invention provides a Light Powered Perimeter Alarm Monitoring System (LPPAM) that relies on photoelectric cell powered wireless security sensors to monitor for an intrusion within a home (e.g., door sensors and/or window sensors). In accordance with the principles of the present invention, an optional extender checks the status of LPPAM sensors and relays any possible intrusions to a main control user panel for activation of a user alert.

The LPPAM provides a system and method to monitor windows and doors without retrofitting a building's wiring. The LPPAM eliminates the requirement of maintenance of batteries, i.e., to regularly replace the batteries at each door and/or window sensor within the system.

With the LPPAM, only a small amount of energy storage is required in the unit because the local energy storage is constantly being charged during daylight hours or periods that a local illumination is available. As a result, the size of the door sensors and/or window sensors can be made extremely small. This allows the door sensors and window sensors to discreetly attached to the door or window or to be embedded in the window latch or the door lock, thereby improving the ease and aesthetics of the installation.

Figure 8:
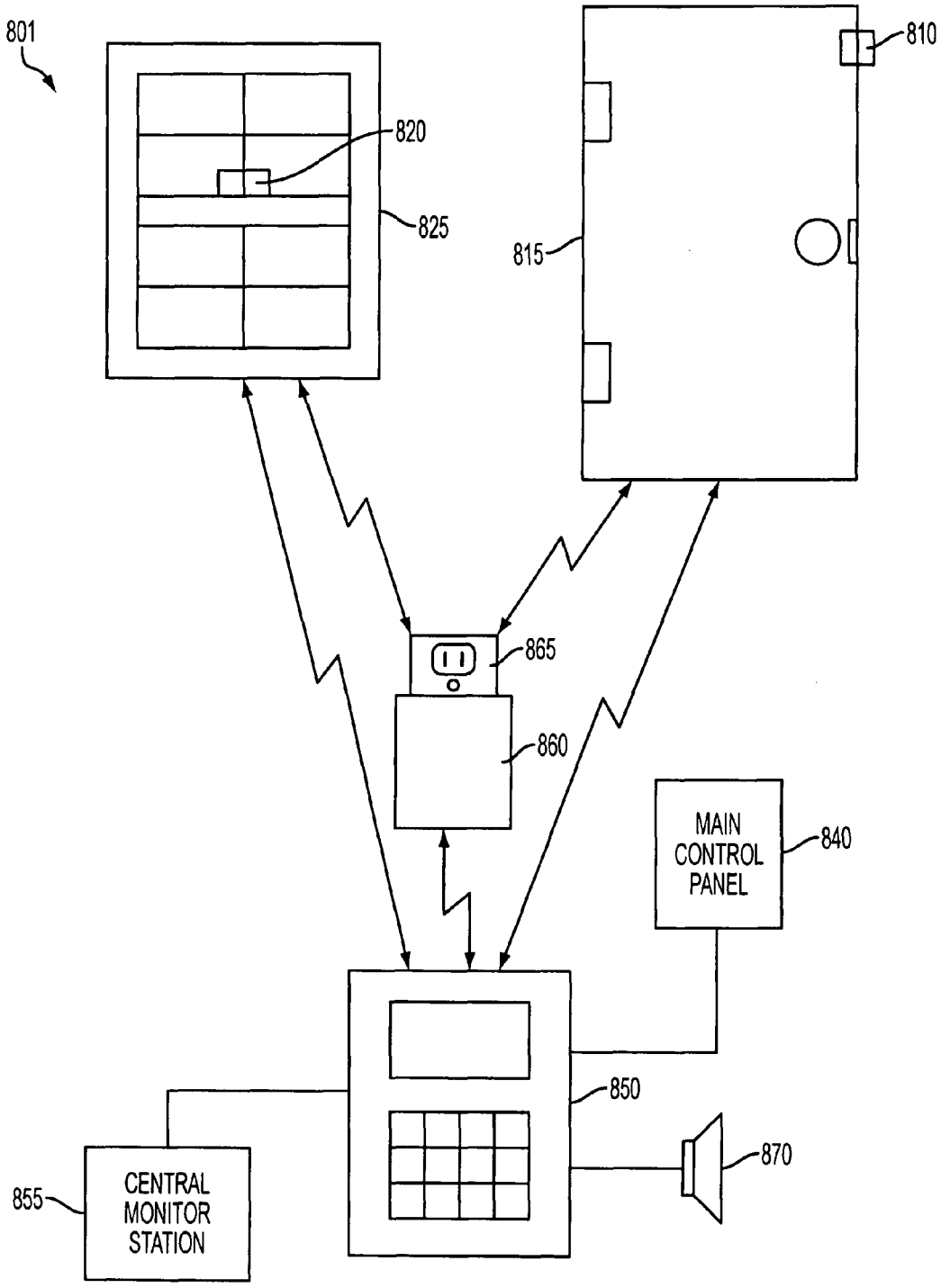
FIG. 8 shows an overview of an alternative of a wireless home security system relying on light power, in accordance with the principles of the present invention.

FIG. 8 shows a system level view of the LPPAM 801, in accordance with the principles of the present invention.

In particular, as shown in FIG. 1, the LPPAM 801 is comprised of a wireless window sensor 820, a window 825, a wireless door sensor 810, a door 815, an optional wireless interface extender 860, a conventional wall outlet 865, a main control panel 840, a remote user panel 850, a central monitoring station 855, and a speaker 870.

A single wireless window sensor 820, a single wireless door sensor 810, a single wireless interface extender 160, and a single user panel 850 are show in FIG. 1 for simplification of illustration only. Within an actual implementation of the LPPAM 801 in accordance with the principles of the present invention, the number of wireless window sensors 820, wireless door sensors 815, wireless interface extender 860, main control panel 840, and user panels 850 is virtually unlimited, i.e., based on the size and configuration of the premises being monitored.

The wireless window sensor 820 is illustrated as being incorporated in a lock mechanism of window 825. To simplify incorporation of a wireless window sensor 820 into a window 825 at the time of manufacture and to retrofit a premises with a wireless door sensor 820 in accordance with the invention, the wireless window sensor 820 can be manufactured to fit within a conventional window lock housing. For retrofit, as well as new installations, this approach with current technology would allow a small, ~0.5" by 0.75" by ⅛" (or smaller) module to be developed to be innocuously placed on a window, in a window, door or lock mechanism to minimize aesthetic objections that exist with currently employed battery powered wireless window sensors.

A spring loaded magnetic switch, a mechanical switch, or similar switch activates the wireless window sensor 820 to signal a possible intrusion within a premises being monitored by the LPPAM 801. To sense an opening of door 815, a second portion of the wireless door sensor 810 is incorporated into a door frame, not shown. Although the wireless door sensor 810 can also be placed within a door frame, not shown, and a second portion can be incorporated into door 815. To simplify incorporation of a wireless door sensor 810 into a door 815 at the time of manufacture and to retrofit a premises with a wireless door sensor 810 in accordance with the invention, the wireless door sensor 810 can be manufactured to fit within a conventional door lock housing. A spring loaded magnetic switch, a mechanical switch, or similar switch embedded in the wireless door sensor 810 to signal a possible intrusion within a premises being monitored by the LPPAM 801.

Moreover, the wireless window sensor 820 and wireless door sensor 810 can be used to detect whether their respective associated window 825 and door 815 latch/lock mechanisms are locked/unlocked. A mechanical switch activates the wireless window sensor 820 and wireless door sensor 810 to signal if the associated window 825 and door 815 is locked/unlocked. In this manner, the LPPAM can be used to determine if windows and doors within a building being monitored are locked/unlocked in addition to monitoring if window 825 and/or door 815 is opened/closed.

The optional wireless interface extender 860 conveniently plugs into a conventional wall outlet 865 for power. The wireless interface extender 860 is optional because of the ability of the wireless window sensor 820 and the wireless door sensor 810 to communicate their respective intrusion status. If the distance between the wireless window sensor 820 and the wireless door sensor 810 is near enough to the main control panel 840 as to establish communications, the wireless interface extender 860 is not required for system functionality. However, a wireless interface extender 860 may be desirable in the event of a battery with the wireless window sensor 820 and the wireless door sensor 810 becomes weak and limits the communications distance from the wireless window sensor 820 and the wireless door sensor 810.

A periodic polling signal is emitted from the wireless interface extender 860 to communicate with the wireless window sensor 820 and the wireless door sensor 810. The value read from the wireless window sensor 820 and the wireless door sensor 810 is transmitted to the main control panel 840. Alternately, to conserve power the wireless window sensor 820 and the wireless door sensor 810 only send sensor data to the main user panel 840 upon a change in status of the wireless window sensor 820 and the wireless door sensor 810.

The main control panel 840 receives the sensor data transmitted from the wireless window sensor 820 and the wireless door sensor 810, and alternately from the wireless interface extender 860. The sensor data is checked for an unexpected opening or a locked/unlocked condition at the time the premises in being secured. If the sensor data shows an unexpected opening of a window or door while the premises is secured, the speaker 870 is activated to alert a user of a potential intruder within a premises being monitored by the LPPAM 801. Optionally, the central monitoring center 855 is called through a telephone interface or wireless interface to alert local police of a possible intrusion. Such central monitoring service is an optional paid service that is not required to operate the LPPAM 801 as a deterrent to an intruder entering a premises with speaker 870 sounding an alarm.

The remote user panel 850 is used to activate and deactivate the LPPAM 801. Moreover, the user panel 850 provides visual indication of the status of the LPPAM 801, such as activation status, individual zone status, etc. The zone status information would be shown on the user panel 850 of the unlocked/unlatched conditions of the door sensor 810 and window sensor 820 at the time that the premises is being secured. If either the door sensor 810 or window sensor 820 is in the unlocked/unlatched condition, the system preferably prevents arming the system until the unlocked/unlatched condition(s) were corrected or they were specifically bypassed.

During initial setup of the LPPAM 801, all of the wireless window sensors 820 and the wireless door sensors 810 sensors within the LPPAM 801 are polled for storage of baseline keycode identity values of the wireless window sensor 820 and the wireless door sensor 810 within the LPPAM 801. The baseline sensor values are constantly compared to polled sensor values from wireless window sensor 820 and the wireless door sensor 810 for a determination of a change in value indicating opening of a latch/lock mechanism and a possible intrusion. An alternative is placing optically scannable labels or an RFID tag on the wireless sensors to program the keycodes into the main control panel 840 to establish a protected net.

As discussed above, a single wireless window sensor 820, a single wireless door sensor 810, a single wireless interface extender 160, and a single user panel 850 are show in FIG. 8 for simplification of illustration only. During an implementation of the LPPAM 801, multiple addresses in the wireless interface extender 860 emulate, as well as differentiate zone types, such as a door open delay area vs. an instant alarm window opening detected.

The wireless window sensor 820 and the wireless door sensor 810 are capable of monitoring and reporting both an opened/closed condition and a locked/unlocked state of a window and door. In this manner a user could verify that all windows and doors within a premises are not only opened/ closed, but also having the addition security of knowing whether all windows and doors within a premises are locked/unlocked.

Figure 9:
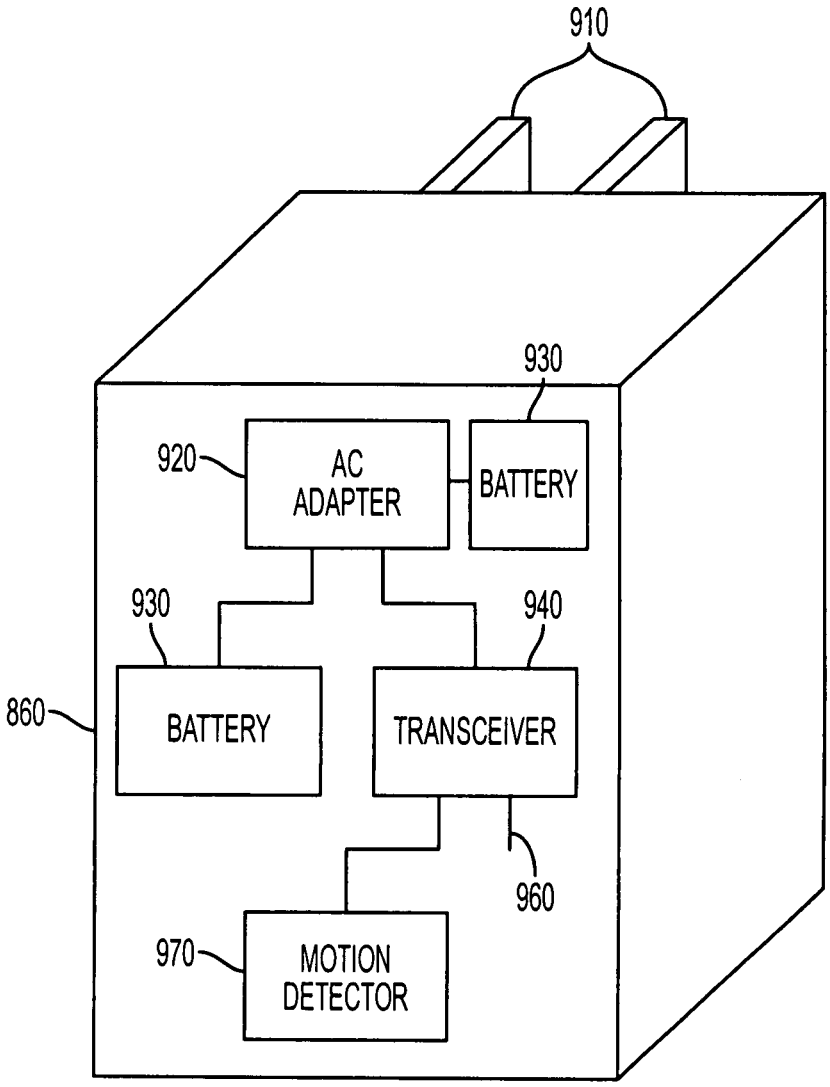
FIG. 9 shows a detailed view of the wireless interface extender from FIG. 8, in accordance with the principles of the present invention.

FIG. 9 shows a detailed view of the wireless interface extender 860 as shown in FIG. 8, in accordance with the principles of the present invention.

In particular, the wireless interface extender 960 is comprised of electrical outlet connectors 910, an AC adapter 920, a battery 930, a transceiver 940, a transceiver antenna 960, and an optional motion detector 970.

The electrical outlet connectors 910 allow the wireless interface extender 860 to receive power from the standard wall outlet 165 shown in FIG. 1.

Battery 930 allows the wireless interface extender 860 to perform its functions in the event that wireless interface extender 860 is unable to obtain power from a conventional wall outlet 865. Although not show in FIG. 9 for convenience, an AC power sensor is used to determine if the wireless interface extender 860 is obtaining power from the conventional wall outlet 865. If the AC power sensor determines that the wireless interface extender 860 is not obtaining power from the conventional wall outlet 865, a switch is triggered to allow the wireless interface extender 860 to be powered by battery 930.

The wireless interface extender 860 provides a communication link with main control panel 840, wireless window sensor 820 and the wireless door sensor 810. In this manner, wireless interface extender 860 acts as a extension bridge relaying sensor data from the wireless window sensor 820 and the wireless door sensor 810 to the main control panel 840 to allow a wireless window sensor 820 and a wireless door sensor 810 that cannot communicate directly with main control panel 840 a path to relay required sensor data to main panel 840.

Optionally, wireless interface extender 860 comprises motion detector 970. The motion detector 970 provides backup intrusion detection in the event that an intruder is able to gain access to a premises without opening window 825 and door 815, and/or in the event that the wireless window sensor 820 and the wireless door sensor 810 become inoperable. Other optional detectors that can be incorporated with the wireless interface extender 860 comprise a glass break detector, fire detector, infrared detector, carbon monoxide detector, etc.

The communications path between the wireless interface extender 860 and the main control panel 840 can utilize any wired or wireless technology, such as X10 power line communications, piconet (such as Bluetooth™), WiFi, HomePNA, Ethernet, etc. The system is optionally compatible with conventional wireless security systems at the interface of the transceiver 940 in the wireless interface extender 860.

Although the exemplary wireless interface extender 860 show in FIG. 1 is shown as being plugged into a conventional wall outlet 865 for power, for a more aesthetic installation the wireless local interface is incorporate into a wall power outlet, a powered smoke detector, a telephone line outlet, a motion detector, a glass break detector, a wall switch, etc., i.e., any other powered outlet that provides for improved installation aesthetics. From all appearances, the wireless local interface would therefore be indistinguishable from a conventional wall power outlet, smoke detector, a telephone line outlet, etc. This arrangement has the advantage of disguising the zones being covered by the LPPAM 801 from an intruder and at the same time freeing an outlet for conventional use of two plug-in devices for power and/or a plug-in for a telephone.

Moreover, wireless window sensor 820, wireless door sensor 810 and wireless interface extender 860 can form an ad hoc security network, such as a piconet (e.g., BLUETOOTH™), to extend the range of coverage of the main control panel 840. A security network can be formed from a plurality of wireless local interfaces for communication with a remote user panel, with the individual components relaying data to the main control panel 840.

Moreover, wireless window-sensor 820, wireless door sensor 810, transceiver antenna 960 and an antenna within the main control panel 840 can be directional antennas for optimizing communications within the LPPAM 801. A directional antenna's orientation can be adjusted to maximize a communication signal's strength and associated distances between components within the LPPAM 801. In this manner, obstruction from such obstacles as other electronics, power lines, pipes, etc. can be minimized.

Figure 10:
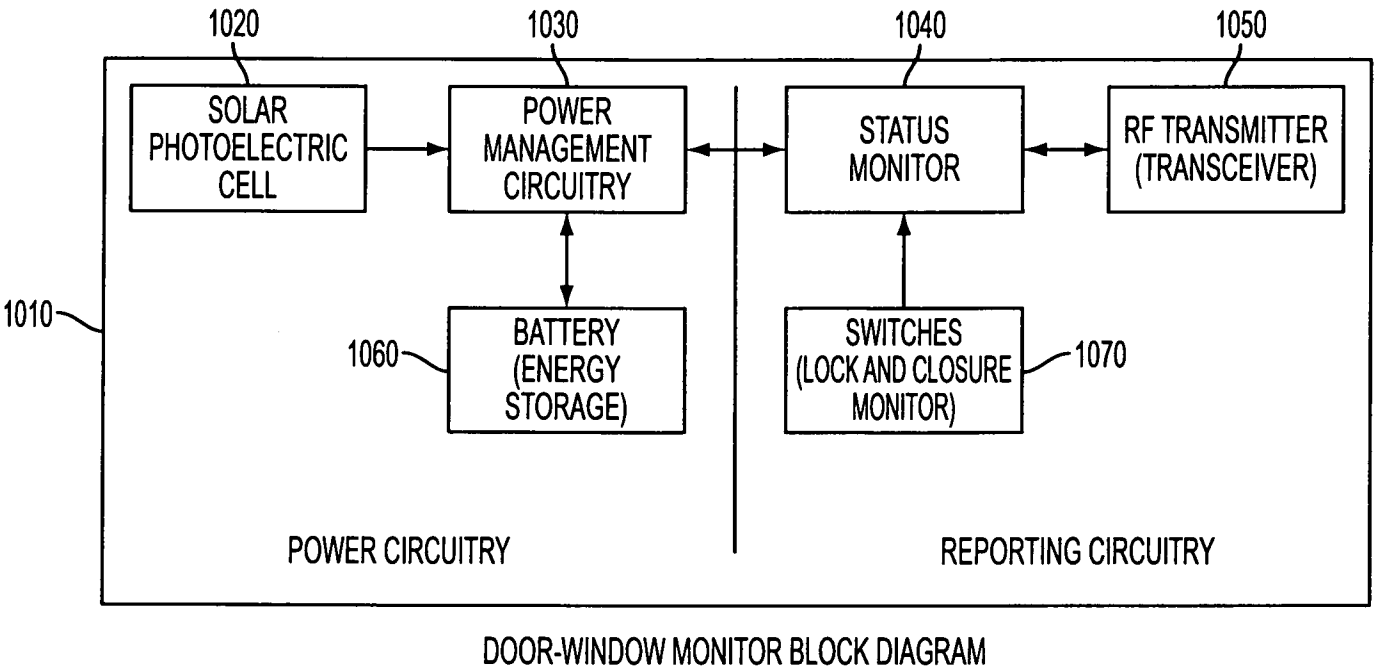
FIG. 10 shows a door-window monitor block diagram, in accordance with the principles of the present invention.

FIG. 10 shows a door-window monitor block diagram for a photoelectric cell powered wireless sensor 1010 that comprises a wireless window sensor 820 and a wireless door sensor 810 as shown in FIG. 8, in accordance with the principles of the present invention.

In particular, the photoelectric cell powered wireless sensor 1010 is shown for convenience as comprising two portions, i.e., a power circuitry portion and a reporting circuitry portion. The power circuitry portion of photoelectric cell powered wireless sensor 1010 is comprised of a photoelectric cell 1020, a power management circuitry 1030 and a battery (energy source) 1060. The reporting circuitry portion of photoelectric cell powered wireless sensor 1010 is comprised of a status monitor 1040, a switch (lock and closure monitor) 1070, and a transceiver 1050.

Photoelectric cell 1020 collects light energy and transforms that energy into electrical energy that is used to power the photoelectric cell powered wireless sensor 1010. The photoelectric cell is envisioned to be a thin film, quantum dot technology, or similar technology that has the characteristics of small size and low ambient light efficiency. This provides efficient energy conversion with minimal required thickness.

Power management circuitry 1030 ensures that battery 1060 is not overcharged to maximize the life of battery 1060. Moreover, power management circuitry 1030 performs power management functions to selectively activate status monitor 1040 to conserve energy stored in battery 1060. Power management circuitry 1030 is optimally a simple CPU or state machine to minimize power draw for reporting LPPAM 801 status.

During sunny times of a day or when a local light is turn on, the photoelectric cell 1020 is optimally outputting electrical energy to allow status monitor 1040 to operate directly from power produced from photoelectric cell 1020 to prevent draining battery 1060, while still providing for battery charging. Intelligent power management maximizes power within battery 1060 to allow status monitor 1040 to operate during extended periods of total darkness, e.g., an interior room with no auxiliary lighting, or when photoelectric cell 1020 is unable to collect enough photoelectric energy to charge battery 1060 and power status monitor 1040.

Energy source 1060 can be also be a capacitor or small rechargeable based "infinite" number of cycles battery technology with minimal memory.

An alternative is to illuminate the photoelectric cell 1020 with InfraRed energy to provide power to the device during periods of prolonged darkness. The InfraRed energy can be directed toward the photoelectric cell 1020 to maximize charging of the energy source 1060.

Although the photoelectric cell powered wireless sensor 1010 is shown herein as comprising a transceiver 1050, the transceiver 1050 can be operated in a unidirectional mode to conserve power. Such a unidirectional mode would preferably be triggered by the power management circuitry 1030 during periods of extended darkness, e.g., nighttime periods, to extend the life of the battery (energy source) 1060.

Figure 11:
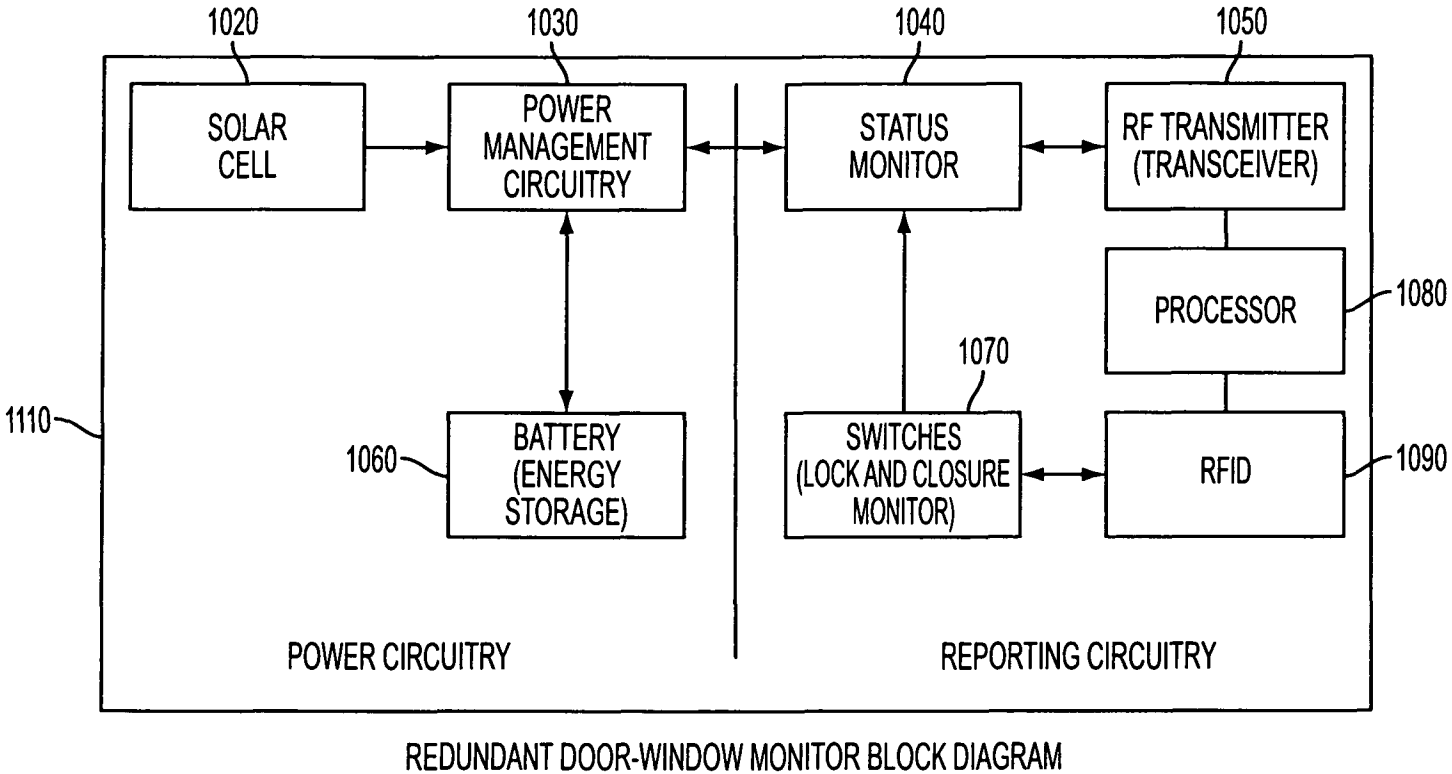
FIG. 11 shows an alternative door-window monitor block diagram, in accordance with the principles of the present invention.

FIG. 11 shows an alternative door-window monitor block diagram for a redundant wireless sensor, in accordance with the principles of the present invention. Redundant wireless sensor 1110 provides the advantages of redundancy over the photoelectric cell powered wireless sensor 1010, shown in FIG. 10, and the wireless local interface 860, shown in FIG. 8. Redundancy is provided in the form of having two ways of communicating a status of wireless security sensor to a main control panel 840.

In particular, the redundant wireless sensor 1110 is comprised of the same components as shown in FIG. 10 for photoelectric cell powered wireless sensor 1010. However, redundant wireless sensor 1110 is further comprised of a processor 1080 and an RFID 1090.

During operation of photoelectric cell powered wireless sensor 1110, processor 1080 relies on RF transceiver 1050 to monitor for an RFID RF field that is attempting to determine a value from RFID tag 1090. If processor 1080 does not detect an RFID RF field within a predetermined amount of time, processor 1080 triggers back-up communications for relaying switch 1070 status to central monitoring station 855. RF transmitter then transmits the status of switch 1070 to central monitoring station 855 and preferably data indicating which particular wireless sensor is not operating properly, i.e., which wireless sensor needed to rely on back-up communications to relay switch 1070 status information.

Although processor 1080 is exemplarily shown as detecting an RFID RF field, a simple logic circuit can be used in conjunction with an RFID RF field detector to activate back-up communications for relaying switch 1070 status to central monitoring station 855. Such a simple logic circuit would save battery energy to maximize communications using RF transmitter 1050.

Energy source 1060 is charged in a similar manner as in the system shown in FIG. 10. However, energy source 1060 would only need to be activated in the event that a status of photoelectric cell powered wireless sensor 1110 where not determinable through RFID 1090.

Although FIG. 11 is described as using photoelectric cell power as backup for the described RFID based security sensor show in FIG. 1, the principles described herein apply equally to using RFID technology as a backup to a photoelectric cell powered security system.

Figure 12:
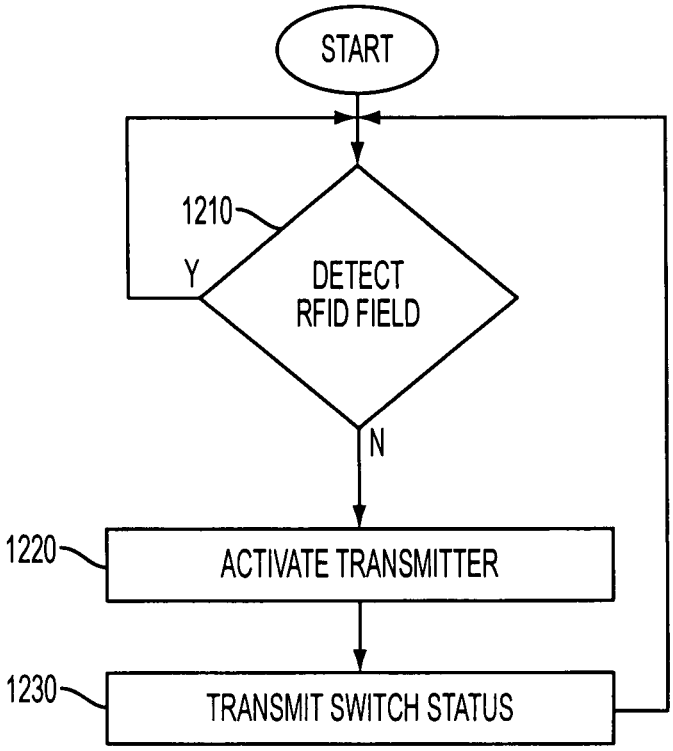
FIG. 12 shows a process by which a wireless security system in accordance with principles of the present invention switches to back-up communications, in accordance with the present invention.

FIG. 12 shows a process by which a wireless security system in accordance with principles of the present invention switches to back-up communications, in accordance with the present invention.

In step 1210, processor 1080 determines if an RFID RF field is detected. If processor 1210 determines that an RFID RF field is detected, processor 1210 continues to monitor for an RFID RF field. If processor 1210 determines that an RFID RF field is undetected within a predetermined amount of time, process flow continues to step 1220.

In step 1220, processor 1210 activates RF transmitter 1050.

In step 1230, transmitter 1050 transmits the status of photoelectric cell powered wireless sensor 1110 to either wireless interface extender 860 or to central monitoring station 855, whichever is within communications range with transmitter 1050.

Figure 13:
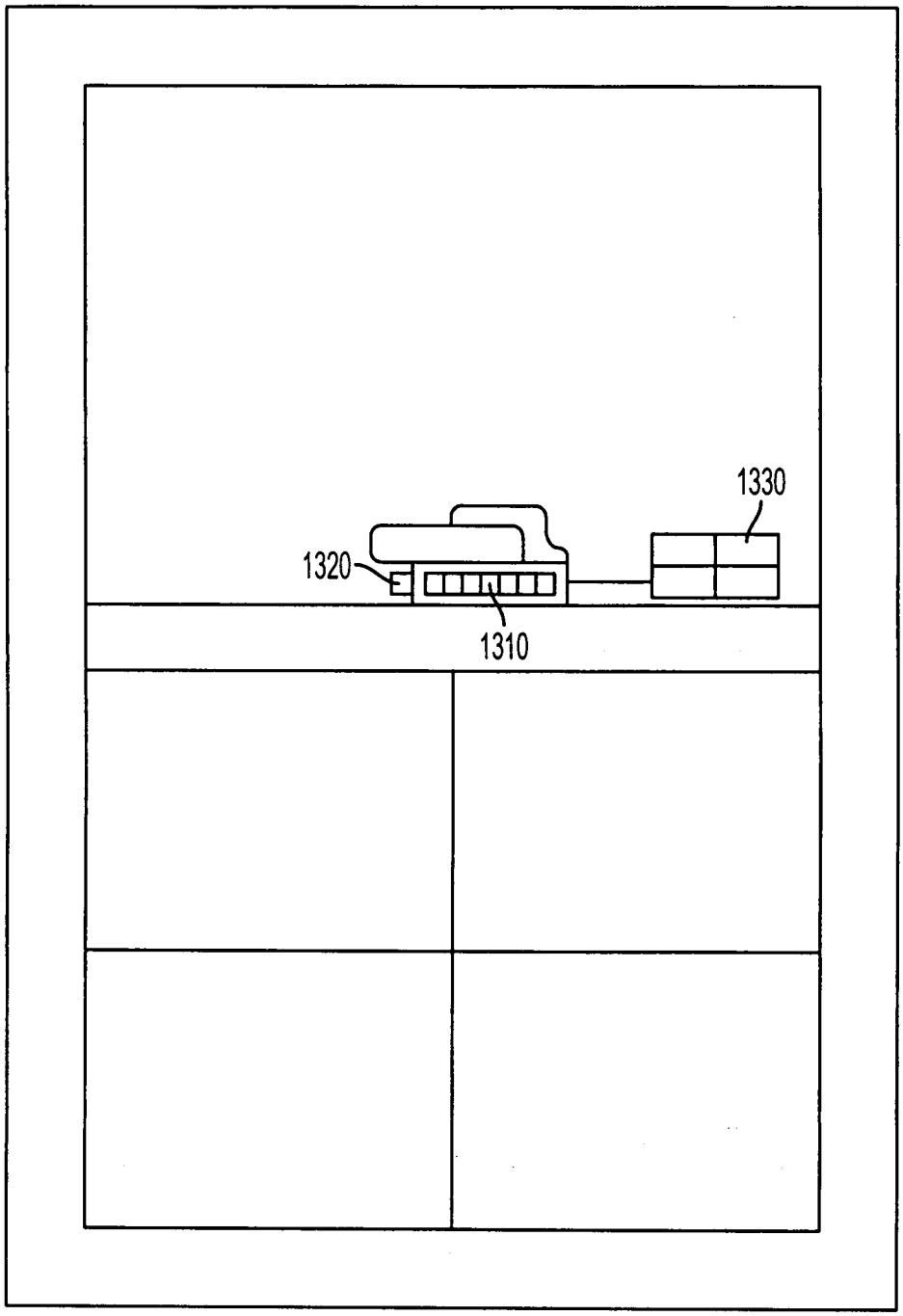
FIG. 13 shows a system for determining an optimal arrangement for a photoelectric cell, in accordance with the present invention.

FIG. 13 shows a system for determining an optimal arrangement for a photoelectric cell 1020, in accordance with the present invention. Although a fixed location for a photoelectric cell 1020 is possible, directing a photoelectric cell 1020 toward an optimal direction to collect the greatest amount of photoelectric energy can be beneficial in certain applications. In low light applications, such as in a heavily treed area, a user would certainly desire to optimally direct photoelectric cell 1020 toward a particular direction possibly where light energy is available for a greater portion of a 24 hour day. To direct photoelectric cell 1020 toward a particular direction, photoelectric cell 1020 would be pivotally positioned on a wireless window sensor 820, a wireless door sensor 810 and/or an optional external photoelectric cell 1330.

In particular, wireless window sensor 820 further comprises a test button 1320, a Liquid Crystal Display (LCD) meter 1310, and an optional external photoelectric cell 1330.

A user with the desire to optimally position photoelectric cell 1020 or optional external photoelectric cell 1330 would depress test button 1320 to activate LCD meter 1310. Depressing test button 1320 would preferably cause all power from photoelectric cell 1020 or optional external photoelectric cell 1330 to be directed toward LCD meter 1310. A user would then adjust the orientation of photoelectric cell 1020 or adjust the orientation and placement of optional external photoelectric cell 1330 while pressing test button 1320 to obtain a visual indication of the amount of energy being produce by photoelectric cell 1020 or optional external photoelectric cell 1330. Testing of the wireless window sensor can be performed at a time of day that is representative of when the sun's strength is the greatest, such as approximately noon, to determine an optimal arrangement when battery 1060 charging is at its greatest potential.

Figure 14:
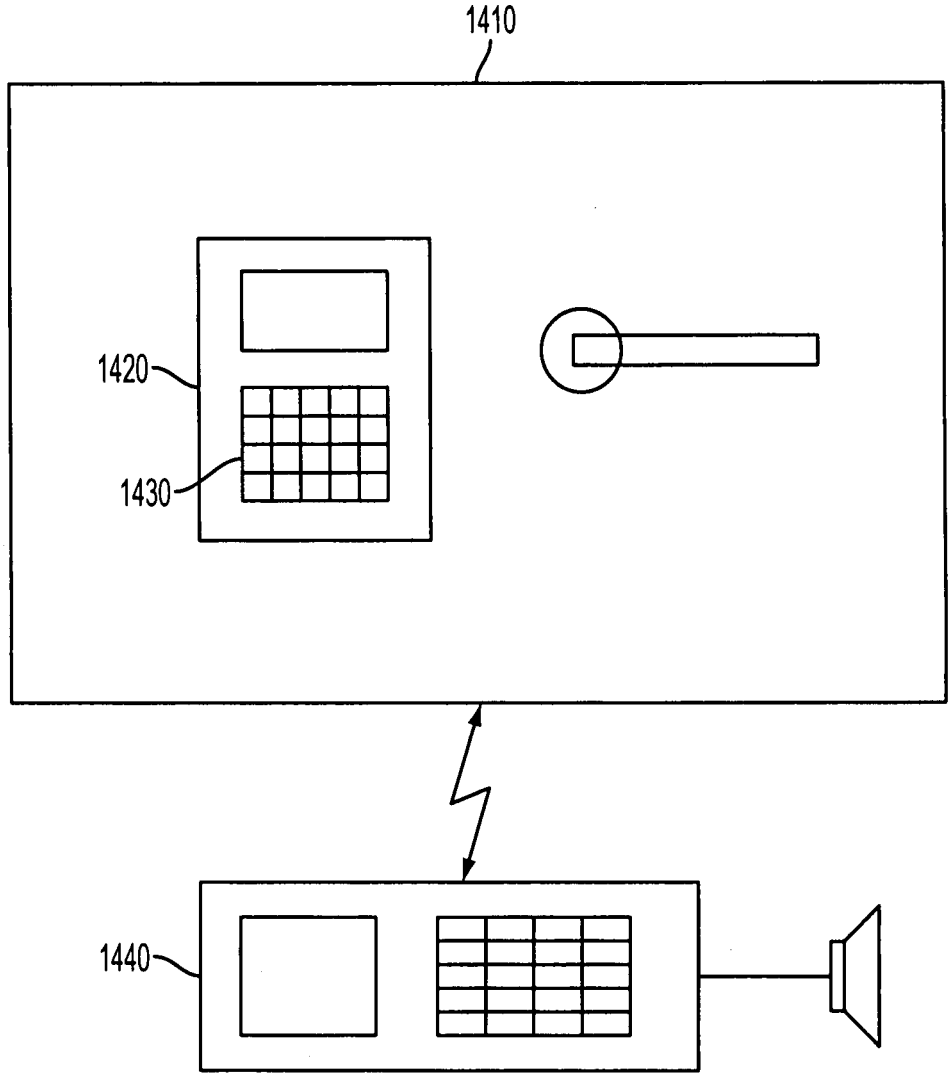
FIG. 14 shows a security safe relying on RFID based sensors as disclosed in FIG. 1, in accordance with the principles of the present invention.

FIG. 14 shows a security safe 1410 incorporating features from the RPAM 101 as disclosed in FIG. 1. Such a security safe is commonly found in homes, banks, military installations, businesses, hotel rooms, etc. to securely store ones valuables.

The security safe 1410 is comprised of a security entry panel 1420. The wireless safe sensor 1430 similar to the wireless window sensor 120 and the wireless door sensor 110 as disclosed in FIG. 1 and the photoelectric cell powered wireless sensor 1010 as disclosed in FIG. 10 is preferably incorporated into security entry panel 1420. Although the wireless safe sensor 1430 is preferably incorporated into security entry panel 1420 for convenience, wireless safe sensor 1430 can be incorporated into any portion of the security safe 1410 that allows for detection of an opened/closed and/or locked/unlocked condition of security safe 1410.

The wireless safe sensor communicates with the same central monitoring station 155 disclosed in FIG. 1 and/or alternately a separate safe monitoring station 1440. The central monitoring station 155 and/or safe monitoring station 1440 allow for remote determination if the security safe 1410 is opened/closed and/or locked/unlocked. The safe monitoring station 1440 can comprise a personal computer programmed to display status information of security safe 1410.

The central monitoring station 155 and safe monitoring station 1440 are preferably programmed to provide historical information on the opened/closed condition and locked/unlocked condition of the security safe 1410, such as the times and duration of when the security safe 1410 was opened/closed and/or locked/unlocked. Such historical information allows a user to determine if the security safe was accessed and re-locked without their permission.

The wireless safe sensor 1430 can comprise any of the configurations disclosed herein for a window and door sensor. In particular, the wireless safe sensor 1430 can be activated by a polling signal similar to that as disclosed in FIG. 1, can be activate by photoelectric power similar to that as disclosed in FIG. 10, and/or a combination of a polling signal and photoelectric power as disclosed in FIG. 10.

The security safe 1410 is show by example to rely on technology from RPAM 101. However, the security safe 1410 can incorporate technology from LPPAM 801, and even use the redundant technology as disclosed in FIG. 11, while still adhering to the spirit and scope of the invention.

While the invention has been shown and described with reference to the provision of a security system relying on photoelectric and RFID technology, the principles disclosed herein relate equally to use of any passive security sensors that lack a power source and are wirelessly remotely polled for a determination of a status of the passive security sensor.

While the invention has been shown and described with reference to a security system incorporating the novel features described herein, a conventional wired and conventional wireless security system can be retrofitted with the components described. Retrofitting a conventional wired and conventional wireless security system eliminates some of the costs associated with having to buy a new remote user panel and speaker. An emulation security module would emulate components within a conventional wired and conventional wireless security system to allow existing components to communicate within the novel components described herein.

While the invention has been shown with a motion detector within wireless interface extender 860, an additional motion detector can be incorporated anywhere within the system to generate an alert if motion is detected within the vicinity of the motion detector.

As the present invention is directed toward a security system, encryption would preferably be used with all communications disclosed herein to prevent interception of security messages flowing within the system and disablement of the security system.

While the invention has been described with reference to the exemplary embodiments thereof, those skilled in the art will be able to make various modifications to the described embodiments of the invention without departing from the true spirit and scope of the invention.

What is claimed is:

1. A redundant security sensor, comprising:

a photoelectric cell;

a security switch;

a passive identification tag to transmit a binary value modified according to a condition of said security switch; and a processor to monitor for a passive identification tag radio frequency field from a remote passive identification tag reader, and if said passive identification tag radio frequency field is not detected, to trigger a backup wireless transmitter, distinct from said passive identification tag, to wirelessly transmit said stored binary value with power generated from said photoelectric cell.

2. The redundant security sensor according to claim 1, wherein:

said photoelectric cell is manually adjustable toward a light source.

3. The redundant security sensor according to claim 1, further comprising:

an energy storage device to store energy produced by said photoelectric cell.

4. The redundant security sensor according to claim 1, wherein:

said wireless transmitter is a piconet transceiver.

5. The redundant security sensor according to claim 1, wherein:

said wireless transmitter transmits to a wireless interface extender.

6. The redundant security sensor according to claim 5, wherein:

said wireless interface extender is integrated into at least one of a wall power outlet, a telephone line outlet, a smoke detector, a motion detector, a glass break detector and wall switch.

7. The redundant security sensor according to claim 1, wherein:

said passive identification tag is a Radio Frequency Identification (RFID) tag.

8. The redundant security sensor according to claim 1, wherein:

said redundant security sensor is integrated into a window lock.

9. The redundant security sensor according to claim 1, wherein:

said redundant security sensor is integrated into a door lock.

10. The redundant security sensor according to claim 1, wherein:

said redundant security sensor is integrated into a security safe.

11. The redundant security sensor according to claim 5, wherein:

said wireless interface extender comprises a motion detector.

12. The security sensor according to claim 1, wherein:

said sensor data is an open/close condition.

13. The security sensor according to claim 1, wherein:

said sensor data is a lock/unlocked condition.

* * * * *